US007292262B2

(12) United States Patent
Towery et al.

(10) Patent No.: US 7,292,262 B2
(45) Date of Patent: Nov. 6, 2007

(54) ELECTRONIC FIREARM SIGHT, AND METHOD OF OPERATING SAME

(75) Inventors: Clay E. Towery, Plano, TX (US); James M. Florence, Dallas, TX (US)

(73) Assignee: Raytheon Company, Waltham, MA (US)

( * ) Notice: Subject to any disclaimer, the term of this patent is extended or adjusted under 35 U.S.C. 154(b) by 783 days.

(21) Appl. No.: 10/624,293

(22) Filed: Jul. 21, 2003

(65) Prior Publication Data

US 2005/0018041 A1 Jan. 27, 2005

(51) Int. Cl.
*H04N 7/18* (2006.01)

(52) U.S. Cl. ..... 348/61; 348/139

(58) Field of Classification Search ..... 348/130–180
See application file for complete search history.

(56) References Cited

U.S. PATENT DOCUMENTS

| | | | | |
|---|---|---|---|---|
| 3,545,356 | A | 12/1970 | Nielsen | |
| 3,645,602 | A | 2/1972 | Clave et al. | |
| 3,785,261 | A | 1/1974 | Ganteaume | |
| 3,871,741 | A | 3/1975 | Clave et al. | |
| 3,911,451 | A | 10/1975 | Vockenhuber | |
| 3,936,822 | A | 2/1976 | Hirschberg | |
| 4,219,263 | A | 8/1980 | West | |
| 4,290,219 | A | 9/1981 | Boller et al. | |
| 4,309,095 | A | 1/1982 | Buckley | |
| 4,313,273 | A * | 2/1982 | Matthews et al. | 42/117 |
| 4,452,458 | A | 6/1984 | Timander et al. | 273/310 |
| 4,531,052 | A | 7/1985 | Moore | |
| 4,541,191 | A | 9/1985 | Morris et al. | |
| 4,553,943 | A | 11/1985 | Ahola et al. | 434/22 |
| 4,561,204 | A | 12/1985 | Binion | |
| 4,584,776 | A | 4/1986 | Shepherd | |
| 4,630,911 | A | 12/1986 | Paul | |
| 4,641,931 | A | 2/1987 | Loy | |
| 4,835,621 | A | 5/1989 | Black | |
| 4,907,022 | A | 3/1990 | Myers | |

(Continued)

FOREIGN PATENT DOCUMENTS

EP 0 162 493 11/1985

(Continued)

OTHER PUBLICATIONS

PCT search report for PCT/US2004/023664, 7 pages, Jun. 1, 2005.

(Continued)

*Primary Examiner*—Anand Rao
(74) *Attorney, Agent, or Firm*—Haynes and Boone, LLP

(57) ABSTRACT

A firearm sight can detect engagement of a firing pin with a cartridge, and can respond to this event by saving an image which shows a target and reticle at a point in time just prior to the detected event. An electronic reticle can be downloaded into the sight. The effective position of the reticle within the sight can be adjusted electronically, and a zoom factor of the sight can be adjusted electronically. The sight can sense approximately transverse movement thereof, and can provide a user with an indication of the amount of transverse movement. With the use of an additional device, the sight can automatically align its reticle to the bore of a firearm on which the sight is mounted.

23 Claims, 3 Drawing Sheets

U.S. PATENT DOCUMENTS

| | | | | |
|---|---|---|---|---|
| 4,936,190 | A | 6/1990 | Pilcher, II | |
| 4,965,439 | A | 10/1990 | Moore | |
| 4,970,589 | A | 11/1990 | Hanson et al. | |
| 4,989,024 | A | 1/1991 | Myers | |
| 5,020,262 | A | 6/1991 | Pena | |
| 5,026,158 | A | 6/1991 | Golubic | |
| 5,285,273 | A | 2/1994 | James et al. | |
| 5,287,644 | A | 2/1994 | Bolduc | |
| 5,347,740 | A | 9/1994 | Rather et al. | |
| 5,366,229 | A | 11/1994 | Suzuki | |
| 5,375,072 | A | 12/1994 | Cohen | |
| 5,406,730 | A | 4/1995 | Sayre | |
| 5,425,299 | A | 6/1995 | Teetzel | |
| 5,442,483 | A | 8/1995 | Monari | |
| 5,455,868 | A | 10/1995 | Sergent et al. | |
| 5,459,696 | A | 10/1995 | Dovrat et al. | |
| 5,483,362 | A | 1/1996 | Tai et al. | |
| 5,491,919 | A | 2/1996 | Rather et al. | |
| 5,544,129 | A | 8/1996 | McNelis | |
| 5,589,903 | A | 12/1996 | Speggiorin | |
| 5,641,288 | A * | 6/1997 | Zaenglein, Jr. | 434/21 |
| 5,686,690 | A | 11/1997 | Lougheed et al. | 89/41.17 |
| 5,826,360 | A | 10/1998 | Herold et al. | |
| 5,917,775 | A | 6/1999 | Salisbury | |
| 5,973,998 | A | 10/1999 | Showen et al. | |
| 5,991,043 | A | 11/1999 | Andersson et al. | 356/400 |
| 6,000,163 | A | 12/1999 | Gordon | |
| 6,005,711 | A | 12/1999 | Mai et al. | |
| 6,247,259 | B1 | 6/2001 | Tsadka et al. | |
| 6,269,581 | B1 | 8/2001 | Groh | |
| 6,363,223 | B1 | 3/2002 | Gordon | |
| 6,373,628 | B1 | 4/2002 | Gunnarsson et al. | |
| 6,425,697 | B1 | 7/2002 | Potts et al. | |
| 6,516,699 | B2 | 2/2003 | Sammut et al. | |
| 6,539,661 | B2 * | 4/2003 | Hope | 42/119 |
| 6,580,876 | B1 | 6/2003 | Gordon | |
| 6,678,395 | B2 | 1/2004 | Yonover et al. | |
| 6,967,775 | B1 | 11/2005 | Millett | |
| 6,988,331 | B2 | 1/2006 | Holmberg | |
| 7,089,845 | B2 | 8/2006 | Friedli et al. | |
| 2002/0197584 | A1 * | 12/2002 | Kendir et al. | 434/21 |
| 2004/0020099 | A1 | 2/2004 | Osborn, II | |
| 2004/0025396 | A1 | 2/2004 | Schlierbach et al. | |
| 2004/0231220 | A1 | 11/2004 | McCormick | |
| 2005/0268521 | A1 | 12/2005 | Cox et al. | |
| 2006/0005447 | A1 * | 1/2006 | Lenner et al. | 42/111 |
| 2006/0010760 | A1 | 1/2006 | Perkins et al. | |
| 2006/0048432 | A1 | 3/2006 | Staley, III | |

FOREIGN PATENT DOCUMENTS

| | | |
|---|---|---|
| EP | 0 276 099 | 7/1988 |
| EP | 0 535 410 | 4/1993 |
| EP | 0 985 899 | 3/2000 |
| EP | 1 304 539 | 4/2003 |
| FR | 2.044.465 | 2/1971 |
| FR | 2.181.500 | 12/1973 |
| WO | WO 85/03118 | 7/1985 |
| WO | WO 96/41998 | 12/1996 |
| WO | WO 02/46822 | 6/2002 |

OTHER PUBLICATIONS

PCT Search Report (PCT/ISA/220 and 210) and Written Opinion (PCT/ISA/237) dated Jul. 8, 2005 for PCT Application No. PCT/US2004/023664, 15 pages.

U.S. Appl. No. 11/021,752 filed on Dec. 23, 2004 by inventors James M. Florence and Clay E. Towery for "Method and Apparatus for Safe Operation of an Electronic Firearm Sight", 46 pages of text, 5 pages of drawings.

U.S. Appl. No. 11/021,748 filed on Dec. 23, 2004 by inventors James M. Florence and Clay E. Towery for "Method and Apparatus for Safe Operation of an Electronic Firearm Sight Depending Upon Detected Ambient Illumination", 35 pages of text, 5 pages of drawings.

U.S. Appl. No. 11/021,749 filed on Dec. 23, 2004 by inventors James M. Florence and Clay E. Towery for "Method and Apparatus for Safe Operation of an Electronic Firearm Sight Depending Upon the Detection of a Selected Color", 36 pages of text, 5 pages of drawings.

* cited by examiner

ELECTRONIC FIREARM SIGHT, AND METHOD OF OPERATING SAME

TECHNICAL FIELD OF THE INVENTION

This invention relates in general to a device which facilitates accurate aiming of a firearm and, more particularly, to a firearm sight mounted on the firearm, through which a user observes a potential target.

BACKGROUND OF THE INVENTION

Over the years, various techniques and devices have been developed to help a person accurately aim a firearm, such as a rifle or target pistol. One common approach is to mount on the firearm's barrel a sight or scope, through which the person views the intended target in association with a reticle, often with a degree of magnification. Although existing firearm sights of this type have been generally adequate for their intended purposes, they have not been satisfactory in all respects.

For example, existing sights typically are passive optical devices with mechanical adjustments. For example, they have fixed reticles with mechanical reticle adjustments, and/or mechanical adjustments to vary the magnification or zoom factor. Over time, these mechanical adjustments are subject to change, for example due to factors such as vibration, shock and wear.

A further consideration is that, in existing firearm sights, a user basically observes the relative positions of the reticle and target while aiming the firearm. When the target is relatively small, it can be difficult for the user to assess how precisely he or she is holding the reticle on the target. For example, one user may not be able to hold the firearm quite as steady as another user, resulting in differences in accuracy. However, in each case, the aiming errors can be so small that it is difficult for either user to perceive these errors by simply observing the relative positions of the reticle and target.

Yet another consideration is that the ability to accurately place a bullet in a target is a function of both mechanical factors and a human factor. The mechanical factors include bullet ballistics, bullet dispersion characteristics, and the degree of alignment between the sight and the firearm bore. These characteristics are largely repeatable, and it is thus possible to compensate for them. In contrast, the human factor is not repeatable or predictable, and thus it is difficult to assess this factor or compensate for it. The human factor includes the ability of a shooter to accurately hold the reticle of the sight on a target. Consequently, it is desirable to be able to record an image showing the relative positions of the reticle and target, as viewed by the shooter, at a point in time when the shooter pulled the trigger, and before the firearm experiences the recoil caused by combustion of the gunpowder or other propellant within the cartridge. This can help the user to assess the extent to which it was the human factor rather than mechanical factors which contributed to a shooting error.

Some pre-existing sights have included the capability to record an image showing the reticle and target, but do so in response to detection of the large recoil or acoustic shock produced by the combustion within the cartridge. Detection of this recoil or shock necessarily occurs after the point in time at which the image of interest would need to be recorded. Consequently, these pre-existing devices must buffer a number of images, respond to the detection of combustion by estimating an earlier point in time at which the trigger was probably pulled, and then identify and save one of the buffered images which corresponds to that estimated point in time. Due to a variety of factors such as variation in bullet caliber, this attempt to predict the time at which the trigger was pulled is inherently imprecise, and often results in the saving of an image which is not particularly useful because it represents a point in time too far before or too far after the actual trigger pull. Moreover, the need to buffer a large number of images makes it necessary to dedicate a relatively large amount of memory to this function, which is undesirable.

Still another consideration is the need to align the reticle to the bore of the firearm on which the sight is mounted. A traditional approach is take the firearm to a target range, fire a number of bullets at a target, observe the error in the resulting bullet pattern, mechanically adjust the windage (azimuth) and elevation (pitch) of the reticle, fire a number of additional bullets at a new target, observe the error in the resulting bullet pattern in the new target, mechanically adjust the windage and elevation of the reticle again, and so on. This process is very time consuming, and is also relatively expensive, due to the cost of targets, bullets, transportation to the target range, fees for use of the target range, and so forth.

SUMMARY OF THE INVENTION

From the foregoing, it may be appreciated that a need has arisen for a firearm sight which avoids some or all of the disadvantages associated with pre-existing sights. One form of the invention involves an apparatus that includes a firearm sight which has: a viewing section that permits a user to view an image of a target in association with a reticle; a sensing section for detecting a physical movement of the firearm sight which is characteristic of a firing pin striking a cartridge; and an imaging section responsive to detection by the sensing section of the physical movement for saving an image of the target and the reticle from a point in time just prior to detection of the physical movement.

A different form of the invention involves an apparatus which includes a viewing section that permits a user to view an image of a scene in association with a digital reticle, the viewing section including a reticle adjustment portion which facilitates digital adjustment of the position of the reticle relative to the image.

Yet another form of the invention involves an apparatus which includes a sight having a viewing section and having a port through which a digital reticle can be introduced electronically into the viewing section from externally of the sight, the viewing section permitting a user to view an image of a scene in association with a digital reticle received through the port.

Still another form of the invention involves an apparatus having a firearm sight with a viewing section which includes: an image detector capable of producing a sequence of digital images of a target; a display on which the viewing section presents the sequence of digital images, the display being visible to a user and having a resolution which is less than a resolution of the image detector; and a digital zoom portion which can digitally change an effective size of the digital images as presented on the display.

Another form of the invention involves an apparatus which includes: a viewing section that permits a user to view an image of a scene in association with a reticle; a sensing portion for detecting movement of the viewing section with a component approximately transverse to a line extending from the scene to the viewing section; and a further section for providing the user with information based on the movement of the viewing section detected by the sensing portion.

Still another form of the invention involves an apparatus having a firearm sight which includes: a viewing section configured to permit a user to view an image of a scene in association with a digital reticle; a reticle adjustment portion which facilitates digital adjustment of the position of the reticle relative to the image, the reticle adjustment portion being responsive to radiation received by the firearm sight which is representative of a position of a firearm bore for automatically adjusting the position of the reticle to effect an alignment of the reticle in relation to the firearm bore.

BRIEF DESCRIPTION OF THE DRAWINGS

A better understanding of the present invention will be realized from the detailed description which follows, taken in conjunction with the accompanying drawings, in which.

DETAILED DESCRIPTION

Figure 1:
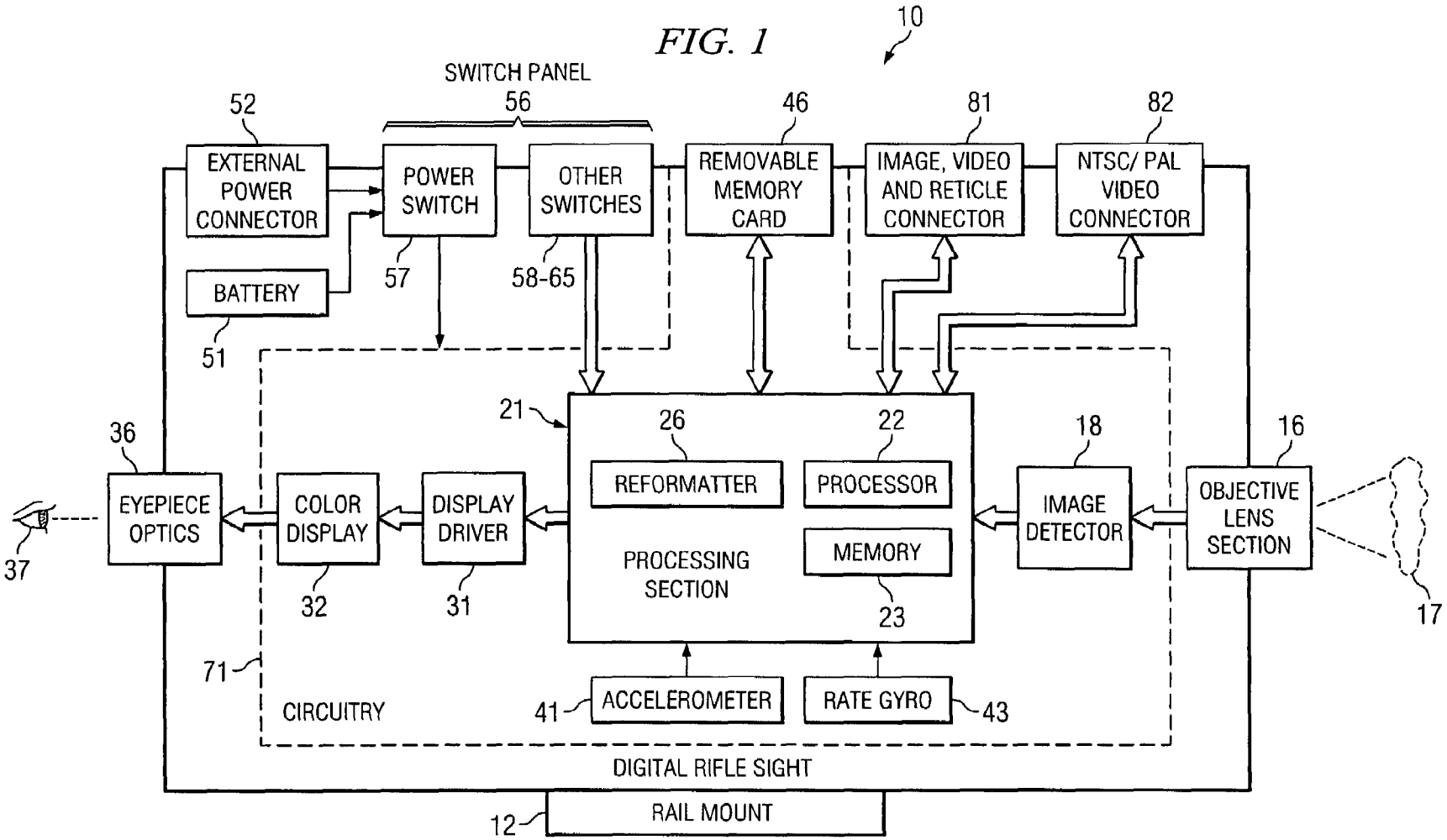
FIG. 1 is a block diagram showing an apparatus which is a digital rifle sight that embodies aspects of the present invention.

FIG. 1 is a block diagram showing an apparatus which is a digital rifle sight 10, and which embodies aspects of the present invention. Although the sight 10 is sometimes referred to herein as a "rifle" sight, it can actually be used not only with rifles, but also with other types of firearms, such as target pistols. The sight 10 includes a rail mount 12, which can fixedly and securely mount the sight 10 on the barrel of a firearm.

The sight 10 includes an objective lens section 16 of a known type. In the disclosed embodiment, the lens section 16 has a field of view (FOV) of 5°, but it could alternatively have some other field of view. The lens section 16 optically images a remote scene or target 17 onto an image detector 18. In the disclosed embodiment, the image detector 18 is a charge coupled device array (CCD array) of a known type, which has 1,920,000 detector elements that each correspond to a respective pixel in each image produced by the image detector 18, and which are arranged as an array of 1600 detector elements by 1200 detector elements. However, the image detector 18 could alternatively be implemented with any other suitable device, including a device having a larger or smaller number of detector elements, or a type of device other than a CCD array, such as a Complementary Metal Oxide Semiconductor (CMOS) image sensor.

The image detector 18 produces a sequence of digital color images of the scene 17, and this sequence of images is supplied to a processing section 21. Although the image detector 18 of the disclosed embodiment produces color images, the images could alternatively be monochrome images, or black and white images. The processing section 21 includes a processor 22 of a known type, and a memory 23. The memory 23 in FIG. 1 is a diagrammatic representation of the memory provided for the processor 22, and may include more than one type of memory. For example, the memory 23 may include a read only memory (ROM) which contains a program executed by the processor 22, as well as data that does not change during program execution. The memory 23 can also include some random access memory (RAM), in which the processor 22 can store data that changes dynamically during program execution. The memory 23 can also include some semiconductor memory of the type commonly known as "flash" RAM, which is random access memory that will maintain information stored in it through a power loss. Memory of this type is commonly used in devices such as memory cards for digital cameras.

The processing section 21 further includes a reformatter 26 of a known type, which is capable of taking an image generated by the image detector 18, and reformatting the image to a lower resolution which is suitable for presentation on a display that has a lower resolution than the image detector 18. Images processed by the reformatter 26 are supplied to a display driver circuit 31, which in turn drives a color display 32. In the disclosed embodiment, the color display 32 is a liquid crystal display (LCD) of a known type, and has 76,800 pixel elements arranged as an array of 320 elements by 240 elements. The display 32 could, however, have a larger or smaller number of pixel elements, or could be any other suitable type of display device, such as a liquid crystal display (LCD), an organic light emitting diode (OLED) display, a liquid crystal on silicon (LCOS) display, or a micro-electro-mechanical system (MEMS) reflective display.

The sight 10 includes eyepiece optics 36 of a known type, which permit the display 32 to be comfortably viewed by an eye 37 of a person using the sight 10 in association with a firearm. In the disclosed embodiment, the eyepiece optics 36 have an FOV of 15°, but could alternatively have some other suitable FOV. In addition, the eyepiece optics 36 of the disclosed embodiment could optionally be omitted for applications which allow a person to directly view the display 32 with a viewing distance greater than about 8 inches, thereby enabling comfortable viewing with little eye accommodation needed.

The sight 10 includes an accelerometer 41, which has an output coupled to the processing section 21. In the disclosed embodiment, the accelerometer 41 is a device which can be obtained commercially as part number ADXL105 from Analog Devices, Inc. of Norwood, Mass. Although the disclosed embodiment implements the accelerometer 41 with the Analog Devices ADXL105 device, the accelerometer 41 could alternatively be implemented with any other suitable device. The accelerometer 41 is a micro-electro-mechanical system (MEMS) device, and serves as a highly sensitive sensor that can detect the relatively small shock wave caused when the firing pin strikes a cartridge within a firearm on which the sight 10 is mounted. Of course, when the firing pin strikes the cartridge, it triggers combustion of the gunpowder or other propellant within the cartridge, so as to expel a bullet or other projectile from the cartridge and firearm.

When the firing pin strikes a cartridge, the output signal from the accelerometer 41 has a frequency spectrum which is different from the frequency spectrum produced in response to combustion of the material within the cartridge. Consequently, the processing section 21 can distinguish a shock wave representative of the firing pin striking a cartridge from a shock wave representing some other type of event, such as combustion within a cartridge. For example, the processing section 21 could apply a fast Fourier transform (FFT) to the output of the accelerometer 41, filter out frequency components which are outside a frequency band of approximately 5 KHz to 10 KHz, and then look for a pulse in the energy between 5 KHz and 10 KHz.

The combustion within the cartridge produces a shock wave or recoil which is several orders of magnitude larger than the shock wave produced when the firing pin strikes the cartridge. The accelerometer 41 has the sensitivity and bandwidth needed to detect the relatively small shock wave which is produced when the firing pin strikes the cartridge, and also has the durability needed to withstand the much larger shock wave or recoil which is produced by the ensuing combustion within the cartridge.

The sight 10 also includes a gyroscope 43, which has an output coupled to the processing section 21, and which is referred to here as a rate gyro. In the disclosed embodiment, the rate gyro 43 is implemented with a MEMS device which is available commercially as part number ADXRS150 from Analog Devices, Inc. Although the disclosed embodiment uses the Analog Devices ADXRS150 device, it would alternatively be possible to implement the rate gyro 43 with any other suitable device.

The rate gyro 43 is capable of detecting angular movement of the sight 10 about a not-illustrated vertical axis which is spaced from the rate gyro 43. Thus, the rate gyro 43 is a highly sensitive device which is effectively capable of detecting movement of the sight 10 in directions transverse to a not-illustrated center line of the objective lens section 16.

The sight 10 also includes a removable memory card 46 which, when present in the sight 10, is operatively coupled to the processing section 21. In the disclosed embodiment, the memory card 46 is a memory card of the type commonly used in digital cameras. However, it would alternatively be possible to use any other suitable device for the removable memory card 46.

The sight 10 includes a battery 51 which, in the disclosed embodiment, is a replaceable battery of a known type. However, the battery 51 could alternatively be a rechargeable battery. The sight 10 also includes an external power connector 52, which can be coupled to an external source of power, such as a converter which converts alternating current (AC) to direct current (DC).

A switch panel 56 has a plurality of manually operable switches, including a power switch 57, and including several other switches 58-65 which are each coupled to the processing section 21 and which are discussed in more detail later. The battery 51 and the external power connector 52 are each coupled to inputs of the power switch 57. When the power switch 57 is respectively actuated and deactuated, it respectively permits and interrupts a flow of current from the battery 51 and/or the connector 52 to circuitry 71 which is disposed within the sight 10, and which requires electrical power in order to operate. The circuitry 71 includes the image detector 18, the processing section 21, the display driver 31, the color display 32, the accelerometer 41, the rate gyro 43, and the memory card 46.

The sight 10 also includes a connector 81 which is coupled to the processing section 21. The connector 81 can can be used to upload image data or video data from the sight 10 to a not-illustrated computer, as discussed later. In addition, the connector 81 can be used to download an electronic reticle from the computer to the sight 10, as also discussed later. In the disclosed embodiment, the physical configuration of the connector 81, as well the protocol for transferring information through it, conform to an industry standard which is commonly known as the Universal Serial Bus (USB) standard. However, it would alternatively be possible to use any other suitable type of connector and communication protocol, such as a standard serial connector and communication protocol, or a standard parallel connector and communication protocol.

The sight 10 also includes a further connector 82, through which video information can be transferred from the sight 10 to an external device, in a manner conforming to an industry video standard which is commonly known as the National Television Standards Committee/Phase Alternating Line (NTSC/PAL) standard. In the disclosed embodiment, the connector 82 is a standard component of the type commonly known as an RCA jack. However, it could alternatively be any other suitable type of connector, and information could be transferred through it according to any other suitable protocol.

Figure 2:
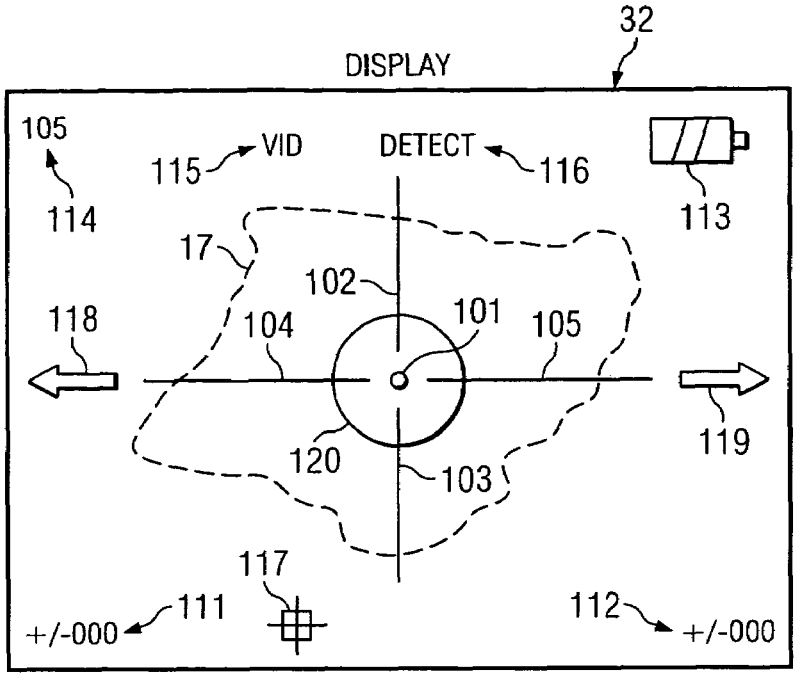
FIG. 2 is a diagrammatic view of a display which is a component of the rifle sight of FIG. 1, as seen by the eye of a person using the sight.

FIG. 2 is a diagrammatic view of the display 32, as seen by the eye 37 of a person looking through the eyepiece optics 36 of the sight 10. In a normal operational mode, the display 32 presents a view of the scene 17, as captured by the image detector 18 through the objective lens section 16. The scene 17 is shown diagrammatically in broken lines in FIG. 2.

The processing section 21 superimposes on the image of the scene 17 a reticle 101-105. In the disclosed embodiment, the reticle includes a small center circle 101, and four lines 102-105 which each extend radially with respect to the circle 101, and which are offset by intervals of 90°. The reticle 101-105 is a digital image, which is downloaded into the sight 10 through the USB connector 81, and which is stored by the processing section 21 in a non-volatile portion of the memory 23. The reticle can have almost any configuration desired by a user. In particular, a reticle with virtually any desired configuration can be created by the user in a separate computer, or obtained by the user from the sight manufacturer or a third party through a network such as the Internet, and then downloaded electronically in digital form through the connector 81 into the memory 23 of the processing section 21.

The processing section 21 takes the reticle which is currently stored in the memory 23, and digitally superimposes the reticle on images that will be sent to the display 32. In FIG. 2, the reticle 101-105 has been superimposed on the image in a manner so that it is centered on the display 32. However, the position where the reticle appears on the display 32, and thus the position of the reticle relative to the image of the scene 17, can be adjusted in a manner which is described later.

The processing section 21 can also superimpose some additional information on the image of the scene 17. In this regard, the lower left corner of the display 32 includes a windage or azimuth adjustment value 111. As mentioned earlier, the position of the reticle 101-105 on the display 32 can be adjusted, in a manner which is discussed in more detail later. The windage adjustment value 111 is a positive or negative number which indicates the offset by which the reticle 101-105 has been adjusted either leftwardly or rightwardly from the centered position shown in FIG. 2. The lower right corner of the display has an elevation or pitch adjustment value 112, which is a positive or negative value indicating the offset by which the reticle 101-105 has been adjusted either upwardly or downwardly from the centered position shown in FIG. 2.

The upper right corner of the display 32 has a battery charge indicator 113 which is divided into three segments, and which is used to indicate the state of the battery 51. In particular, when the battery is fully charged, all three segments of the battery charge indicator 113 are highlighted. Then, as the battery 51 becomes progressively discharged, the number of segments of the battery charge indicator 113 which are highlighted will progressively decrease.

The upper left corner of the display 14 presents an image count value 114, which relates to the fact that the processing section 21 can store images in the removable memory card 46, as discussed later. The image count value 114 is an indication of how many additional images can be stored in the unused space which remains within the memory card 46.

The top center portion of the display 32 has a capture mode indicator 115, and a firing pin detection indicator 116. The capture mode indicator 115 shows which of two capture modes is currently in effect, as discussed later. The firing pin detection indicator 116 indicates whether or not the sight is currently enabled to detect the firing pin striking a cartridge, as discussed later.

The bottom central portion of the display 32 includes an autoboresight alignment indicator 117, for a purpose which is discussed later. The left and right sides of the display 32 each have an arrow 118 or 119, which serves as a respective view indicator for a purpose which is discussed later. In the central portion of the display 32 is an angular error indicator 120. The indicator 120 is a circle which is larger than and concentric to the circle 101 at the center of the reticle 101-105. The diameter of the indicator 120 is increased and decreased in response to variation of a particular operational criteria, as discussed later. Depending on the current mode of operation of the sight 12, the reticle 101-105 and the various indicators 111-120 may all be visible, or only some may be visible.

Figure 3:
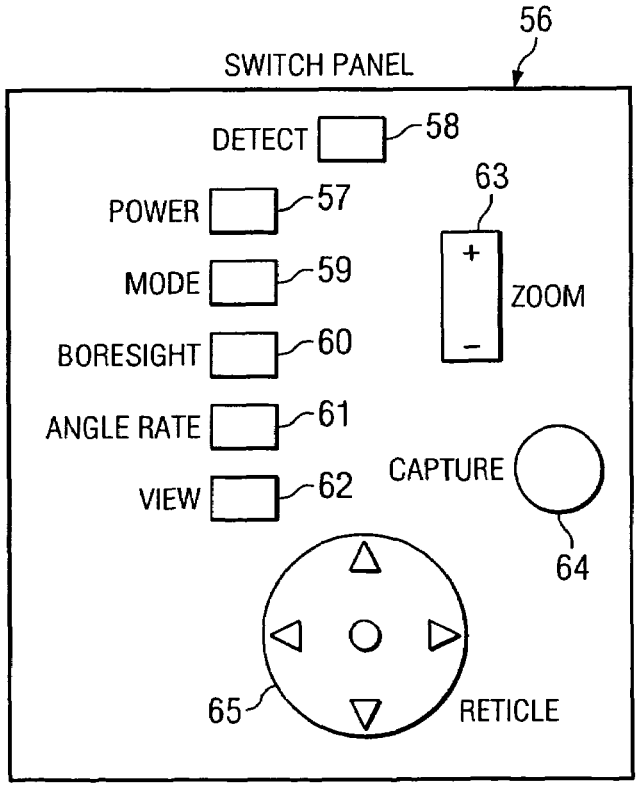
FIG. 3 is a diagrammatic view of a switch panel which is a component of the sight of FIG. 1, and which has a plurality of manually operable switches.

FIG. 3 is a diagrammatic view of the switch panel 56, and shows each of the manually operable switches 57-65 which are present in the switch panel 56. The types of switches and their arrangement on the panel 56 is exemplary, and it would alternatively be possible to use other types of switches, and/or to arrange the switches in a different configuration. The power switch 57 has already been discussed above, and is therefore not discussed again here.

As mentioned earlier, the accelerometer 41 (FIG. 1) is capable of detecting a shock wave which occurs when the firing pin of the firearm strikes a cartridge. Successive manual actuations of the detect switch 58 alternately instruct the processing section 21 to enable and disable this detection feature. When this feature is respectively enabled and disabled, the detection indiator 116 is respectively visible on and omitted from the display 32.

In one operational mode, the processing section 21 of the sight 10 can take a single image generated by the image detector 18, and store this image in the removable memory card 46. In a different operational mode, the processing section 21 can take several successive images generated by the image detector 18, which collectively form a video clip, and store these images in the memory card 46. Successive actuations of the mode switch 59 cause the processing section 21 to toggle between these two operational modes. When the mode for storing video clips is respectively enabled and disabled, the detection indiator 115 is respectively visible on and omitted from the display 32. There are two types of events which will cause the processing section 21 to save an image or a video clip.

First, if the detect switch 58 has been used to enable detection of the firing pin striking a cartridge, the processing section 21 will respond to each detection of this event by saving either a single image or a video clip in the memory card 46, depending on whether the capture mode which has been selected using the mode switch 59 is the image capture mode or the video capture mode. It will be recognized that, since a video clip is a series of several images, saving a video clip in the memory card 46 will take up several times the storage space that would be required to save a single image. After saving an image or video clip, the processing section 21 adjusts the image count indicator 114 presented on the display 32. In particular, if a single image is stored, then the count value 114 will simply be decremented. On the other hand, if a video clip is saved, the value of the indicator 114 will be reduced by an amount which corresponds to the number of images in the video clip.

The other event which will cause the processing section 21 to save one image or a video clip is manual operation of the capture switch 64. Whether the processing section 21 saves a single image or a video clip is dependent on the capture mode which has been selected using the mode switch 59. When the capture switch 64 is manually operated, the processing section 21 selects either a single image or a video clip from the current output of the image detector 18, and then saves this image or video clip in the memory card 46. As mentioned earlier, a separate and not-illustrated computer can be coupled to the connector 81, and the processing section 21 can upload to that computer the images or video clips stored in the memory card 46.

The zoom control switch 63 is a rocker switch. Pressing the upper end of the switch 63 increases the zoom factor, and pressing the lower end decreases the zoom factor. In the disclosed embodiment, the zoom is continuous and can range from 1× to 4×, but it would alternatively be possible to use a non-continuous zoom with several discrete levels, and/or some other zoom range. When the disclosed system is operating at a zoom factor of 4×, a center portion is extracted from each image produced by the image detector 18, where the center portion has a size of 320 by 240 pixels. This center portion is then displayed on the color display 32, with each pixel from the center portion being mapped directly on a one-to-one basis to a respective pixel of the display 32.

When the zoom factor is at 1×, the reformatter 26 essentially takes an entire image from the image detector 18, divides the pixels of that image into mutually exclusive groups which each have 16 pixels arranged in a 4 by 4 format, averages or interpolates the 16 pixels of each group into a single calculated pixel, and then maps each of the calculated pixels to a respective corresponding pixel of the display 32. Similarly, when the zoom factor is at 3×, the reformatter 26 essentially takes an image from the image detector 18, extracts a center portion having a size of about 960 pixels by 720 pixels, divides the pixels of this center portion into mutually exclusive groups which each have 9 pixels arranged in a 3 by 3 format, averages or interpolates the 9 pixels of each group into a single calculated pixel, and then maps each of the calculated pixels to a respective corresponding pixel of the display 32. As still another example, when the zoom factor is at 2×, the reformatter 26 essentially takes from an image from the image detector 18, extracts a center portion having a size of about 640 pixels by 480 pixels, divides the pixels of this center portion into mutually exclusive groups which each have 4 pixels arranged in a 2 by 2 format, averages or interpolates the 4 pixels of each group into a single calculated pixel, and then maps each of the calculated pixels to a respective corresponding pixel of the display 32.

In the disclosed embodiment, the zoom from 1× to 4× is continuous. When the zoom factor is between 1× and 2×, between 2× and 3×, or between 3× and 4×, the reformatter 26 takes a corresponding portion of an image, and then groups, interpolates and maps the pixels of this portion into the pixels of the display 32 in a manner analogous to that discussed above. Although the zoom in the disclosed embodiment is continuous, it would alternatively be possible for the zoom factor to be moved between discrete zoom levels, such as the four discrete zoom levels of 1×, 2×, 3× and 4×.

With reference to FIG. 3, the reticle switch 65 is a four-way switch, and any one of the upper, lower, left or right sides can be manually operated so as to respectively indicate a selection of up, down, left or right. Each time the upper side of the switch 65 is actuated, the position of the reticle 101-105 is adjusted upwardly with respect to the display 32, and thus with respect to the image of the scene 17 which is presented on the display 32. Each such actuation of the switch 65 causes the reticle 101-105 to be moved upwardly by a predetermined number of pixels, and the elevation value 112 in the lower right corner of the display 32 is incremented in response to each such adjustment. Similarly, if the lower side of the switch 65 is actuated, the reticle 101-105 is adjusted downwardly by the predetermined number of pixels with respect to the display 32, and the elevation value 112 is decremented. Similarly, actuation of the left or right side of the switch 65 causes the reticle 101-105 to be adjusted leftwardly or rightwardly by a predetermined number of pixels on the display 32, and causes the windage value 111 in the lower left corner of the display 32 to be either incremented or decremented.

As mentioned above, the sight 10 is capable of capturing and storing single images, or short video clips. In order to view these stored images or clips, the user presses the view switch 62, thereby causing the processing section 21 to stop presenting images of the scene 17 on the display 32, and to instead present either the first still image from the memory card 46, or the first video clip from the memory card 46. If the memory card 46 contains more than one image or video clip, the arrow 119 will be visible to indicate that the user can move forward through the images or video clips. The user presses the right side of the reticle switch 65 in order to move to the next successive image or video clip, and presses the left side of the reticle switch in order to move backward through the images or video clips. The view indicator 119 will be visible except when the user is viewing the last image or video clip, and the view indicator 118 will be visible except when the user is viewing the first image or video clip. The view mode is terminated by pressing the switch 62 a second time, which causes the sight 10 to revert to its normal mode of operation.

The angle rate switch 61 can be operated to enable and disable the display of an angular error rate, as sensed by the rate gyro 43. In particular, successive manual actuations of the switch 61 will alternately enable and disable this function. When this function is respectively enabled and disabled, the angular error indicator 120 is respectively visible on and omitted from the display 32. When this function is enabled, the processing section 21 monitors the output of the rate gyro 43. Typically, the user will be aiming the firearm and attempting to keep the reticle center 101 accurately centered on a portion of the scene 17 which is considered to be a target.

If the user happens to be holding the firearm very steady, the rate gyro 43 will detect little or no angular motion of the sight 10 and the firearm, or in other words little or no transverse movement thereof. Consequently, the processing section 21 will present the indicator 120 as a circle of relatively small diameter, in order to indicate to the user that the firearm is being relatively accurately held on the selected target. On the other hand, if the user is having difficulty holding the firearm steady, the rate gyro 43 will detect the greater degree of angular movement of the firearm and sight. Consequently, the processing section 21 will display the indicator 120 with a larger diameter, thereby indicating that the reticle center 101 is not being held on the target as accurately as would be desirable.

In the disclosed embodiment, the change in the diameter of the indicator 120 is continuous. In other words, a progressive increase in the amount of angular movement of the firearm and sight results in a progressive increase in the diameter of the indicator 120. Conversely, a progressive decrease in the amount of angular movement of the firearm and sight results in a progressive decrease in the diameter of the indicator 120. The user will thus endeavor to squeeze the trigger of the firearm at a point in time when the reticle center 101 is centered on the target, and when the indicator 120 has a relatively small diameter to indicate that the firearm is currently being held very steady.

Figure 4:
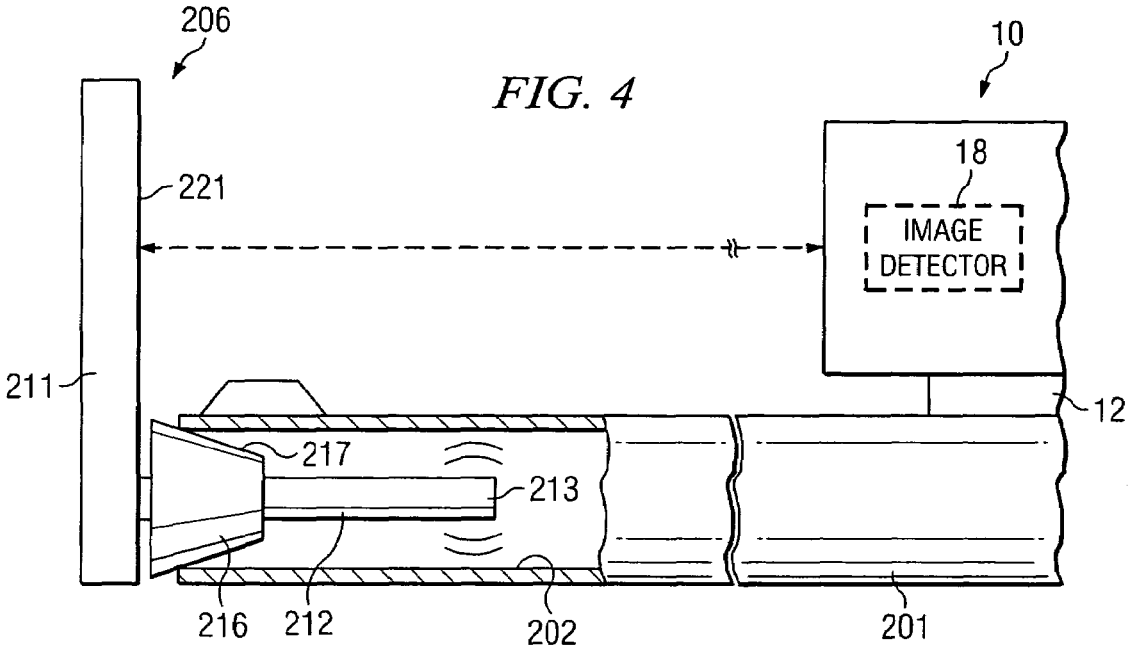
FIG. 4 is a diagrammatic fragmentary side view showing the rifle sight of FIG. 1 mounted on the barrel of a rifle, and showing a boresight alignment device temporarily installed in an outer end of the barrel.

The remaining switch 60 on the switch panel 56 is a boresight switch, which is used to enable and disable an autoboresight alignment mode. When this mode is respectively enabled and disabled, the autoboresight alignment indicator 117 is respectively visible on and omitted from the display 32. The autoboresight alignment mode involves the use of an additional piece of equipment. In particular, FIG. 4 is a diagrammatic fragmentary side view showing the digital rifle sight 10 mounted on the barrel 201 of a rifle by the rail mount 12. The barrel 201 has a bore 202 extending through it. A boresight alignment device 206 is temporarily installed at the outer end of the barrel.

The device 206 includes a platelike body 211, and a cylindrical rod 212 which extends perpendicular to the platelike body 211 and has one end fixedly secured to the lower end of the body 211. In the disclosed embodiment, the body 211 and rod 212 are each made of metal, but they could alternatively be made of some other suitable material. The rod 212 extends concentrically into the bore 202 of the rifle barrel 201, and has an outer end 213 which is magnetized. A frustoconical grommet 216 has a central opening, through which the rod 212 extends. In the disclosed embodiment, the grommet 216 is made of rubber, but it could alternatively be made of some other suitable material. The grommet 216 has a frustoconical surface 217, which engages the bore 202 at its outer end.

The frustoconical surface 217 permits the device 206 to be used with a variety of different types of firearms having bores of different sizes. Further, the surface 217 ensures that the left end of the rod 212 will be substantially centered with respect to the bore of any such firearm. The magnetic forces generated by the right end of the rod 213 act approximately uniformly in all directions, thereby causing the end 213 of the rod 212 to be accurately centered within the bore 202. In this regard, the device 206 is designed so that its center of gravity is in the region of the end of the barrel 201 of the firearm, which reduces the centering force required of the magnetic field. As a result of the magnetic field, the device 206 automatically orients itself so that the rod 212 is accurately centered within and thus coaxial with the bore 202, and so that the platelike body 211 is oriented to be accurately perpendicular to the axis of the bore 202.

The upper end of the body 211 has a reflective surface 221 machined thereon, the surface 221 being perpendicular to the rod 212 and thus the axis of the bore 202, for example through the use of precision machining techniques such as diamond point turning. With the boresight alignment device 206 properly installed and self-oriented at the end of the rifle barrel 201, the reflective surface 221 will "see" the image detector 18 located within the sight 10, and will reflect back to the image detector 18 an image of itself.

Figure 5:
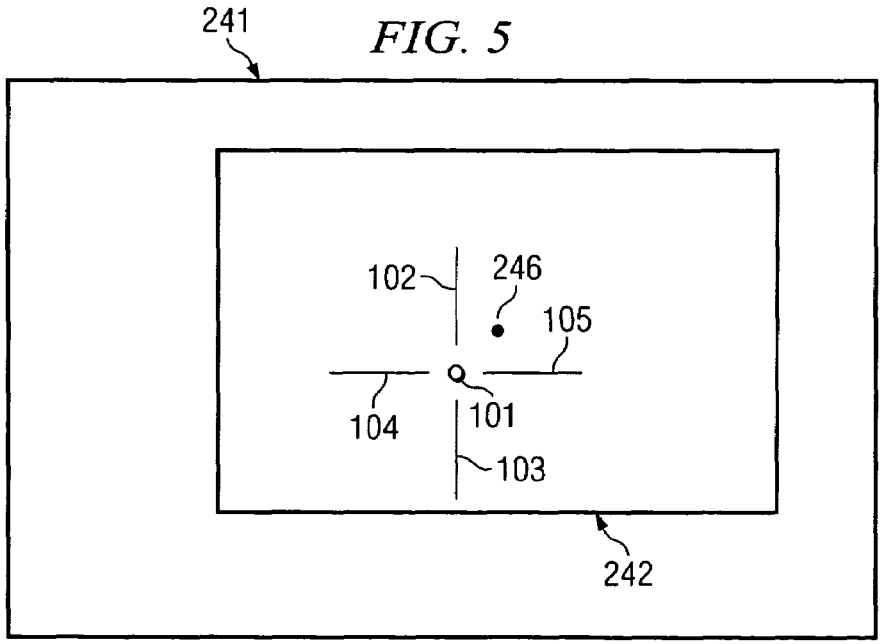
FIG. 5 is a diagrammatic view of an image captured by an image detector of the rifle sight during a boresight alignment operation, with a reticle superimposed on the image.

In this regard, FIG. 5 is a diagrammatic view of an image 241 captured by the image detector 18 during a boresight alignment operation. The reticle 101-105 has been superimposed on the image 241 by the processing section 21. For simplicity, the reticle 101-105 is shown in a centered position, with no offset for windage or elevation. The image 241 includes a rectangular portion 242, which is the image detector 18 as reflected back to itself by the reflective surface 221 on the boresight alignment device 206.

Using image processing techniques of a known type, the processing section 21 can locate the rectangular portion 242 within the image 241, and calculate the centroid 246 of the rectangular portion 242. These known image processing techniques can include operations such as spatial filtering, thresholding, segmentation, feature extraction, and image correlation, and/or other suitable known operations. The processing section 21 can then compare the position of the reticle center 101 to the position of the centroid 246, and automatically adjust the position of the reticle 101-105 in terms of windage and elevation, in order to align the reticle to the reflection of the image detector, and thereby properly align the reticle with the bore of the firearm.

The present invention provides a number of advantages. One such advantage results from the provision of capability to detect the impact of a firing pin striking a cartridge. This provides the ability to accurately record an image which shows the relative positions of the reticle and target, as viewed by a user just before combustion starts within the cartridge. This provides an accurate record of the extent to which an error in bullet placement at the target was due to human error, which is not directly repeatable. In particular, the user can view the stored image in order to isolate his or her contribution to any error in bullet placement at the target.

A further advantage results from the fact that some or all of the adjustments of the firearm sight are effected electronically, rather than mechanically. This avoids errors due to mechanical considerations such as vibration, shock and wear. In the disclosed embodiment, the electronic adjustments include electronic adjustment of a zoom factor, and electronic adjustment of reticle windage and elevation. Further, the reticle itself is electronically downloaded into the firearm sight, and significant changes in the reticle configuration can thus be easily effected without the need for any mechanical change or adjustment.

Still another advantage relates to the provision of capability to accurately measure the line of sight angular rate, and to display for a user an indication the currently sensed angular rate. This provides a person using the firearm with an indication of how precisely he or she is currently controlling the optical line of sight, or in other words how steadily the firearm is currently being trained on the intended target.

Still another advantage results from the provision of capability to automatically and electronically align the reticle of the firearm sight to the bore of the firearm. Further, this automatic alignment can be effected quickly and accurately. This avoids the traditional approach of taking the firearm to a target range and firing successive sequences of bullets while progressively mechanically adjusting the reticle windage and elevation, which is time consuming and expensive. In particular, the invention provides for precise measurement of the misalignment of the scope relative to the bore of the firearm, and automatic correction of the reticle position.

Although one embodiment has been illustrated and described in detail, it will be understood that various substitutions and alternations are possible without departing from the spirit and scope of the present invention, as defined by the following claims.

What is claimed is:

1. An apparatus comprising a firearm sight which includes:

a viewing section that permits a user to view an image of a target in association with a reticle;

a sensing section for detecting a physical movement of said firearm sight which is characteristic of a physical impact associated with a cartridge striking mechanism; and an imaging section responsive to detection by said sensing section of said physical movement for saving an image of the target and said reticle from a point in time just prior to detection of said physical movement.

2. An apparatus according to claim 1, wherein said imaging section is responsive to detection by said sensing section of said physical movement for saving a sequence of images of the target and said reticle from a time interval which begins before detection of said physical movement, one of said images in said sequence being said image from said point in time.

3. An apparatus according to claim 1, wherein said image saved by said imaging section is a digital image.

4. An apparatus according to claim 3, wherein said viewing section includes:

a digital image detector capable of producing a sequence of images of the target; and a display on which said viewing section presents for a user said sequence of images with said reticle superimposed thereon.

5. An apparatus according to claim 1, wherein said sensing section includes a solid state electronic accelerometer.

6. An apparatus according to claim 5, wherein said physical impact involves a physical impact with a firing pin; and wherein said sensing section effects bandpass filtering of an output of said accelerometer to select energy with frequency components characteristic the physical impact with the firing pin.

7. An apparatus comprising a viewing section which permits a user to view an image of a scene in association with a digital reticle, said viewing section including a reticle adjustment portion which facilitates digital adjustment of the position of said reticle relative to the image.

8. An apparatus according to claim 7, wherein said reticle adjustment portion permits a user to manually effect said adjustment of the position of said reticle.

9. An apparatus according to claim 7, wherein said reticle adjustment portion permits a user to manually effect said adjustment of the position of said reticle independently in two different directions.

10. An apparatus according to claim 7, wherein said viewing section includes:

an image detector capable of producing a sequence of digital images of said scene; and a display which is visible to a user and on which said viewing section presents said sequence of digital images with said digital reticle superimposed thereon, said reticle adjustment portion affecting adjustment of the position of said reticle by changing the position at which said reticle is superimposed on said display.

11. An apparatus according to claim 7, including a rifle sight, said viewing section being a portion of said rifle sight.

12. An apparatus comprising a sight having a viewing section and having a port through which a digital reticle can be introduced electronically into said viewing section from externally of said sight, said viewing section permitting a user to view an image of a scene in association with a digital reticle received through said port.

13. An apparatus according to claim 12, wherein said viewing section includes:

an image detector capable of producing a sequence of digital images of said scene; and a display which is visible to a user and on which said viewing section presents said sequence of digital images with the digital reticle superimposed thereon.

14. An apparatus according to claim 12, wherein said sight is a rifle sight.

15. An apparatus comprising a firearm sight with a viewing section which includes:

an image detector capable of producing a sequence of digital images of a target;

a display on which said viewing section presents said sequence of digital images, said display being visible to a user and having a resolution which is less then a resolution of said image detector; and a digital zoom portion which can digitally change an effective size of said digital images as presented on said display.

16. An apparatus comprising:

a viewing section which permits a user to view an image of a scene in association with a reticle;

a sensing portion for detecting movement of said viewing section which has a component approximately transverse to a line extending from said scene to said viewing section; and a further section for providing the user with information based on said movement of said viewing section detected by said sensing portion.

17. An apparatus according to claim 16, wherein said information provided by said further section includes an indicator which is presented in association with said scene and said reticle, and which has a size that is varied as a function of changes in said movement of said viewing section as detected by said sensing portion.

18. An apparatus according to claim 17, wherein said indicator is a circle which has a centerpoint disposed at a predetermined location on said reticle, and which has a diameter that is varied as a function of changes in said movement of said viewing section as detected by said sensing portion.

19. An apparatus according to claim 16, wherein said movement detected by said sensing portion is a rate of angular movement of said viewing section with respect to a vertical reference.

20. An apparatus according to claim 16, including a rifle sight, said viewing section, sensing portion and further section being respective portions of said rifle sight.

21. An apparatus comprising a firearm sight which includes:

a viewing section configured to permit a user to view an image of a scene in association with a digital reticle;

reticle adjustment portion which facilitates digital adjustment of the position of said reticle relative to said image, said reticle adjustment portion being responsive to radiation received by said firearm sight which is representative of a position of a firearm bore for automatically adjusting the position of said reticle to effect an alignment of said reticle in relation to the firearm bore.

22. An apparatus according to claim 21, wherein said viewing section includes an image detector; and including a device which is separate from said firearm sight, which has a first portion engageable with the firearm bore for supporting said device in a position of alignment with the firearm bore, and which has a second portion with a reflective characteristic, said radiation representative of a position of the firearm bore being a reflection onto said to said image detector by said second portion of an image of said image detector.

23. An apparatus according to claim 22, wherein said reticle adjustment portion effects said automatic adjusting of the position of said reticle in a manner which includes determining a centroid of said reflection of said image detector, and then adjusting the position of said reticle relative to said centroid.

* * * * *

UNITED STATES PATENT AND TRADEMARK OFFICE

CERTIFICATE OF CORRECTION

PATENT NO. : 7,292,262 B2
APPLICATION NO. : 10/624293
DATED : November 6, 2007
INVENTOR(S) : Clay E. Towery and James M. Florence It is certified that error appears in the above-identified patent and that said Letters Patent is hereby corrected as shown below:

Claim 10, Column 13, Line 1, the word “affecting” should read as -- effecting --.

Claim 15, Column 13, Line 27, the word “then” should read as -- than --.

Claim 22, Column 14, Line 38, the line should read as --being a reflection onto said image detector by--.

Signed and Sealed this

Eighteenth Day of March, 2008

JON W. DUDAS
*Director of the United States Patent and Trademark Office*